US005196765A

United States Patent [19]

MacMaster et al.

[11] Patent Number: 5,196,765

[45] Date of Patent: Mar. 23, 1993

[54] HIGH RF ISOLATION CROSSED-FIELD AMPLIFIER

[75] Inventors: George H. MacMaster, Lexington; Lawrence J. Nichols, Burlington, both of Mass.

[73] Assignee: Raytheon Company, Lexington, Mass.

[21] Appl. No.: 220,659

[22] Filed: Jul. 5, 1988

[51] Int. Cl.[5] ..... H01J 25/34

[52] U.S. Cl. ..... 315/39.3; 315/3.6

[58] Field of Search ..... 315/39.3, 3.6

[56] References Cited

U.S. PATENT DOCUMENTS 3,448,330 6/1969 Farney ..... 315/39.3
3,577,172 5/1971 Dench ..... 315/39.3
4,082,979 4/1978 Farney et al. ..... 315/39.3
4,677,342 6/1987 MacMaster et al. ..... 315/39.3

*Primary Examiner*—Theodore M. Blum
*Attorney, Agent, or Firm*—Martin M. Santa; Richard M. Sharkansky

[57] ABSTRACT

A crossed-field amplifier tube is constructed in which there is substantially no direct RF coupling between the output of the slow-wave structure on the anode and the input of the slow-wave structure of the cathode to thereby obtain a cathode-driven tube which is capable of RF pulsed operation into a linear accelerator cavity which presents a mismatched load, a short circuit impedance, at initiation and termination of the RF pulse without breaking into oscillation. During the RF pulse, the tube operates into a substantially matched load and provides high peak and average power.

32 Claims, 5 Drawing Sheets

HIGH RF ISOLATION CROSSED-FIELD AMPLIFIER

BACKGROUND OF THE INVENTION

This invention relates to crossed-field amplifiers and in particular to a crossed-field amplifier capable of stable operation into variable loads such as exhibited by linear accelerators (LINAC's). Crossed-field amplifiers as known in the prior art will not operate stably into linear accelerators.

An input of a linear accelerator which comprises a resonant cavity through which a pulsed electron beam is passed looks like a short circuit to a pulsed RF input signal drive source during the build up and decay of the RF field in the cavity at the beginning and end of the pulsed RF input signal, respectively. During the remainder of the pulse of RF input, the cavity impedance is constant and preferably matched to the input signal source impedance. It is during the short circuit impedance mismatch to a CDCFA signal source that the CDCFA is most vulnerable to becoming an oscillator because of the power reflected back to the CDCFA output from the linear accelerator cavity through a connecting waveguide. A klystron will operate satisfactorily into such a load. However, a klystron having sufficiently high peak and average power output is substantially heavier and occupies substantially more volume than the CDCFA of this invention which is small and light weight.

In order to have stable operation without self-oscillation when operating into a linear accelerator, an amplifier must have a high degree of RF isolation between its input and its output. Also, to have high gain without self-oscillation, an amplifier must have a high degree of RF isolation between its input and its output. Cathode-driven crossed-field amplifiers (CDCFA) available in the prior art have typically an RF isolation of 30 dB. A typical CDCFA has a frequency band of 14% with an RF gain capability of about 28 dB available before self-oscillation becomes a problem. It is a further object of this invention to increase the RF isolation to as much as 60 to 65 dB in order to obtain more RF gain and also to have the capability of operating into a mismatched load.

In the conventional CDCFA, the RF drive signal is introduced at the source of the electrons. This is accomplished by forming the cathode into a slow-wave structure that will support microwave energy. In the cathode-driven tubes, the amount of RF coupling between the anode and cathode circuits has a strong affect on the tube behavior. In typical forward-wave and backward wave CDCFA's where broadband operation is desired, the cathode and anode circuit diameters have a ratio only slightly greater than one which limits the RF isolation and hence the RF gain. Also, in the typical CDCFA, the cathode structure is tightly coupled to the space charge around the entire interaction space.

SUMMARY OF THE INVENTION

The aforementioned problem of self-oscillation is overcome when operating into a linear accelerator and other objects and advantages of the invention are provided by the crossed-field amplifier tube design in accordance with the invention. A tube is constructed in which there is substantially no direct RF coupling between the slow-wave structure on the anode and the slow-wave structure of the cathode to thereby obtain a tube which is capable of operating into a mismatched load such as a short circuit impedance without breaking into oscillation and operating into a substantially matched load and providing high peak and average power. The transition of the load from a short circuit to a matched load may occur during the activation pulse applied to the crossed-field amplifier such as when the CFA is energizing a cavity of a linear accelerator.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENT

Figure 1:
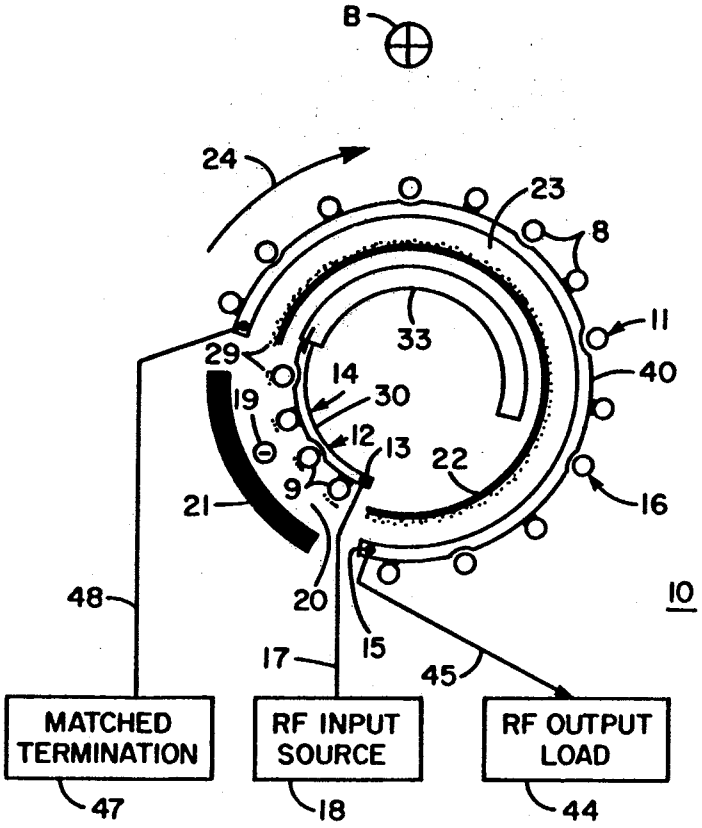
FIG. 1 is a schematic end view of an embodiment of the crossed field amplifier of this invention.

FIG. 1 is a schematic end view of a high RF isolation cathode driven crossed-field amplifier (CDCFA) 10 showing the azimuthal relationship of the anode 11 and the cathode 12. In order to have high gain without self-oscillation, an amplifier must have a high degree of RF isolation between the input 13 of the cathode slow-wave structure 14 and the output 15 of the anode slow-wave structure 16. An objective of the CDCFA of this invention is to provide a tube having an isolation of at least 60 db between input 13 and output 15. This degree of isolation allows the RF output load 44 connected to output 15 to be a linear accelerator cavity which presents a short circuit at the initiation and termination of pulsed RF source 18, and presents a matched load condition after RF energy has built up in the cavity during the pulse. Matched terminations 33, 47 terminate the slow-wave structures 14, 16 to prevent reflections.

In the cathode driven CFA, the RF drive signal is introduced at the cathode source of electrons. This is accomplished by forming the cathode 12 into the slow-wave structure 14 which supports microwave energy. In cathode driven tubes, the amount of RF coupling between anode and cathode circuits has a strong affect on the tube behavior. In typical forward-wave cathode driven CFA's of the prior art, the small ratio between cathode and anode diameters limits the RF isolation and hence the RF gain which is obtainable without oscillation. In typical prior art cathode driven CFA's, the cathode structure is tightly coupled to the space charge around the entire interaction space between the anode and cathode slow-wave structures. In this invention, in order to reduce RF coupling between the cathode RF input 13 and the anode RF output 15, the cathode slow-wave circuit 14 is tightly coupled to the electron space charge 19 only in interaction region 20 opposite a smooth-plate anode region 21. This structure enables the RF drive power on the cathode slow-wave circuit 14 to phase sort the electrons 19 in a region of minimum RF coupling between the anode 11 and cathode 12. The electrons in the region 20 which are emitted at a time of unfavorable phase of the field provided by the cathode slow-wave circuit 14 will take energy from the RF field and bombard the electron emitting surface 22 of the cathode slow-wave circuit 14 to produce secondary electrons. Electrons which are emitted from the cathode slow-wave circuit 14 at a time corresponding to a favorable phase of the electromagnetic energy in the interaction region 20 contribute their potential energy to the RF field in the interaction region 20. The circumferentially rotating electron space charge 19 moves radially from the cathode slow-wave structure 14 rapidly with time and contributes its energy to the anode slow-wave structure 16. RF energy 24 rotates circumferentially in a clockwise direction from input 13 to output 15. The direction of circumferential rotation of space charge 19 preferably results from the backward wave mode of operation wherein the phase velocity (and electron space charge 19) is counterclockwise as viewed in FIG. 1 because this mode has a dispersion curve (radian frequency vs. phase shift) which results in a narrower bandwidth of the CFA. The backward wave CFA has greater stability against oscillation when pulsed into a narrow band cavity (a LINAC input for example) resonant at the center frequency of the CFA. A forward wave dispersion curve results in a broader bandwidth CFA and a greater possibility of oscillation when operating into the same type of load.

As shown in FIG. 1, the cathode slow-wave circuit 14 is opposite a smooth section 21 of the anode 11. This arrangement provides a high degree of isolation between the RF drive signal on the input 13 of the cathode slow-wave circuit 14 and the amplified RF signal on the anode slow-wave circuit 16 and its RF output 15. An interaction region 23 exists between the cathode 12 which has a smooth cylindrical secondary sole plate 22 with electron emitter surface 29 radially opposite the slow-wave structure 16 of the anode 11 in order to reduce RF coupling between the anode 11 and cathode 12. Region 23 provides further isolation between the anode and cathode slow-wave circuits 16, 13.

Figure 2:
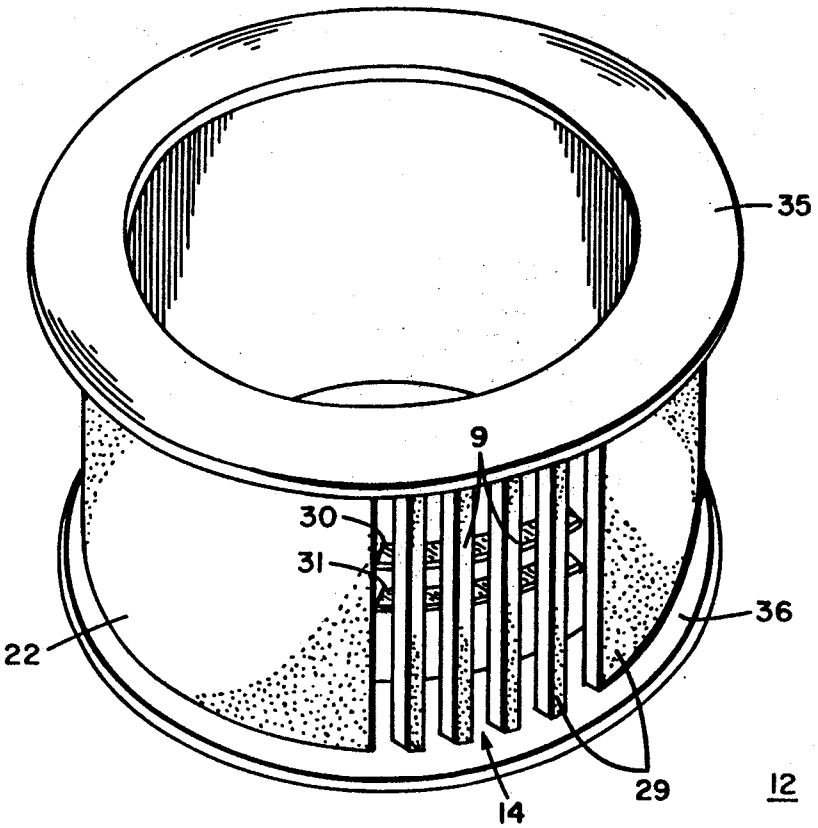
FIG. 2 is an isometric view of the cathode of the crossed-field amplifier of FIG. 1.
Figure 3:
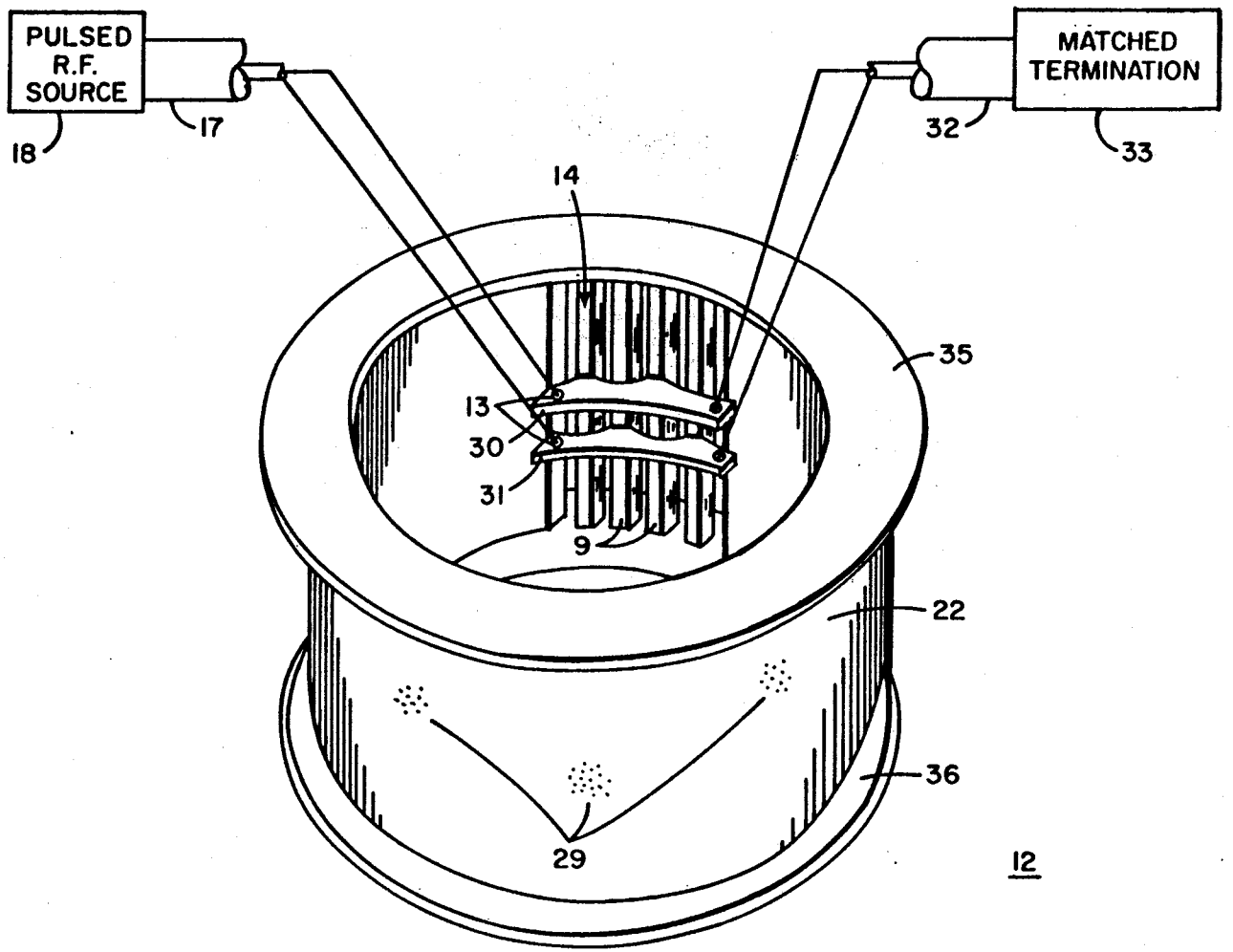
FIG. 3 is an isometric view showing the interior electrical connections to the slow-wave circuit of the cathode of FIG. 2.

FIG. 2 is a pictorial representation of a typical cathode 12 utilized in this invention which corresponds to the schematic view of the cathode 12 of FIG. 1. Several strapped bars 9 constitute the slow-wave structure 14 of cathode 12 with the remainder being the cylindrical electron emitting sole 22. The cathode slow-wave structure should have a sufficient number of strapped bars 9 or vanes to cause the emitted electrons to bunch or spoke in the interaction region 20 to the degree required to get the desired gain and signal-to-noise properties from the CDCFA 10. Straps 30, 31 extend over the circumferential extent of the bars 9 with the straps 30, 31 connected to every other bar, respectively, as shown in FIG. 3 which is a view of the bars 9 as they would be observed from the interior of the cathode 12. Electrical connection is made to the straps 30, 31 at their respective ends 13, 13' to the RF source 18 input line 17 and to output line 32 which is terminated in matched termination 33. Termination 33 is most conveniently fabricated of a cylindrical lossy dielectric which is placed inside the hollow cathode 12 as shown in FIG. 1. Cathode 12 has end shields 35, 36 which confine the electrons produced from the emitting surface 29 of bars 9 and sole plate 22 to the interaction regions 20, 23 of FIG. 1. Emitting surface 22 preferably terminates before reaching end shields 35, 36.

Figure 4:
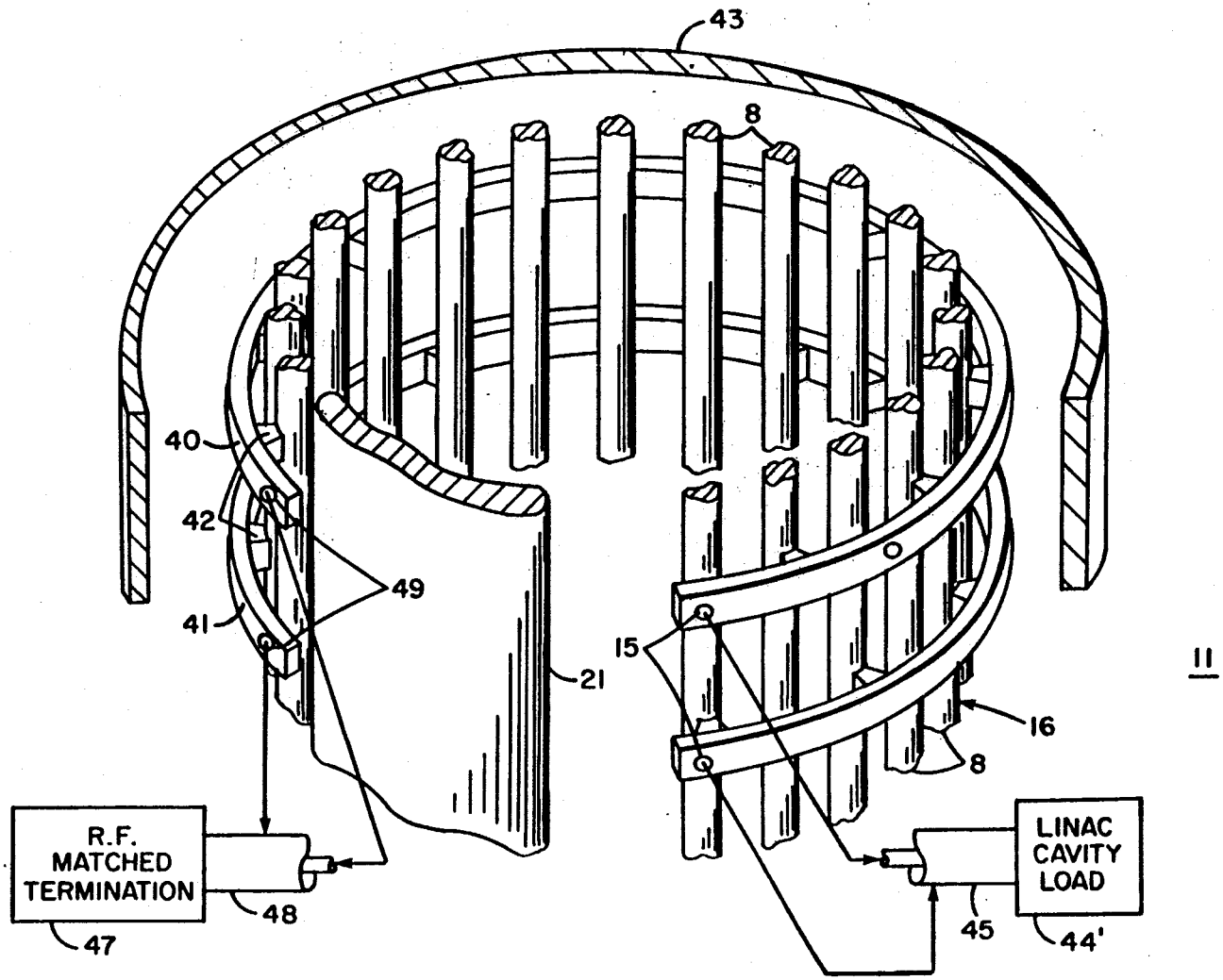
FIG. 4 is a sectioned isometric view of the anode of the crossed-field amplifier of FIG. 1.

FIG. 4 is a pictorial representation of the anode 11 of FIG. 1 in which a small portion of the anode 11 structure is an electrically conducting wall 21 of cylindrical shape which extends over an arc coextensive with the arc of the slow-wave structure 14 of cathode 12. The remainder of anode 11 comprises the slow-wave structure 16 comprised of strapped bars 8 or vanes both greater in number than those of the cathode 12 in order to get greater power output from the CDCFA 10. The dispersion characteristics of the anode and cathode slow-wave structures 16, 14 are preferably matched for coupling to electron cloud 19. Straps 40, 41 are electrically connected by electrically conducting pedestals 42 to alternate bars, respectively. An outer electrically conductive cylindrical shell 43 forms the outer wall of the CFA which is sealed to end walls (not shown) as is well known to those skilled in the art of CFA tubes. The amplified RF signal coupled to the anode slow-wave structure 16 by the electron cloud 19 in the interaction region 23 of FIG. 1 is coupled to an RF load 44 in FIG. 1 (LINAC CAVITY LOAD 44' in FIG. 4) by a circuit coupled to the straps 40, 41 represented by wire 45. Power contained in the slow-wave circuit 16 of anode 11 which is reflected from the load 44 to the anode slow-wave circuit 16 is coupled out to an RF matched termination 47 by appropriate RF coupling mechanism shown in FIG. 4 as wire 48 connected to ends 49 of straps 40, 41.

The complete CFA tube 10 comprises a cathode 12 of FIG. 3 concentric with the interior of the anode 11 of FIG. 4. The orientation of the bars 9 of cathode 12 of FIG. 2 is such that they are azimuthally aligned to coincide with the anode cylindrical plate 21 of FIG. 4. In operation, the RF input signal on line 17 is applied to one end of the cathode slow-wave structure 14 to provide an electric field in the interaction region 20 between the slow-wave structure 14 and the anode cylindrical plate 21. The axial length of the bars 9 of the cathode slow-wave structure 14 and the length of the straps 30, 31 between the adjacent bars 14 is such that at the frequency of the RF input, a $\pi$-mode electric field is established between adjacent bars 9 thereby resulting in the desired electric field in the interaction region 20. The slow-wave structure 16 of the anode 11 is also constructed so that the bars 8 together with their interconnecting straps 40, 41 produce a $\pi$-mode field excitation between adjacent bars 8 resulting in the desired field in the interaction region 23 between the slow-wave structure 16 and the cathode electron emitting sole plate 22. As is well known by those skilled in the art, the term "$\pi$-mode" refers to the fact that the energization of adjacent bars is such that when one bar has maximum positive electric potential, the bars on either side have maximum negative electric potential. The RF field existing in the interaction region 20 causes bunching in the form of spokes of electron cloud 19. Also, the axial direction of the magnetic field B and the polarity of the voltage applied between the negative cathode 12 and the positive anode 11, causes the electron cloud 19 to move in the interaction region 20, 23. The electron cloud energy is gradually transferred to the anode 11 by coupling of the cloud of electrons 19 to the slow-wave structure 16 of the anode. The direction of propagation of RF energy 24 in the anode slow-wave structure 16 is in the clockwise direction and is removed from the slow-wave structure 16 by the output 15 at the last bar 8 of the slow-wave structure 16.

As mentioned earlier, the RF field produced by the cathode slow-wave circuit 14 in the interaction region 20 produces bunching of the electron cloud 19 in the form of radially extending spokes of a high density of electrons separated by regions of lower density of electrons. After the bunched electron cloud 19 leaves the interaction region 20 by moving in a clockwise direction as viewed in FIG. 1, the cloud enters the anode interaction space 23 where the bunched electron cloud 19 acts upon the slow-wave structure 16 of the anode to induce current in the bars 9 to produce a substantially $\pi$-mode of electric field in the structure 16. The current induced in bars 9 and the resulting field produced thereby acts upon the electron cloud 19 in a manner opposite that produced by the slow-wave structure 13 of the cathode. Namely, energy is extracted from the bunched electron cloud 19, and as a result causes dispersion of the electrons in the vicinity of cathode 12 as the cloud moves in a circumferential direction in the interaction region 23. The debunching of the electron cloud 19 as it progresses circumferentially in the interaction region 23 results in an increase in the noise level of the anode 11 output signal.

Figure 5:
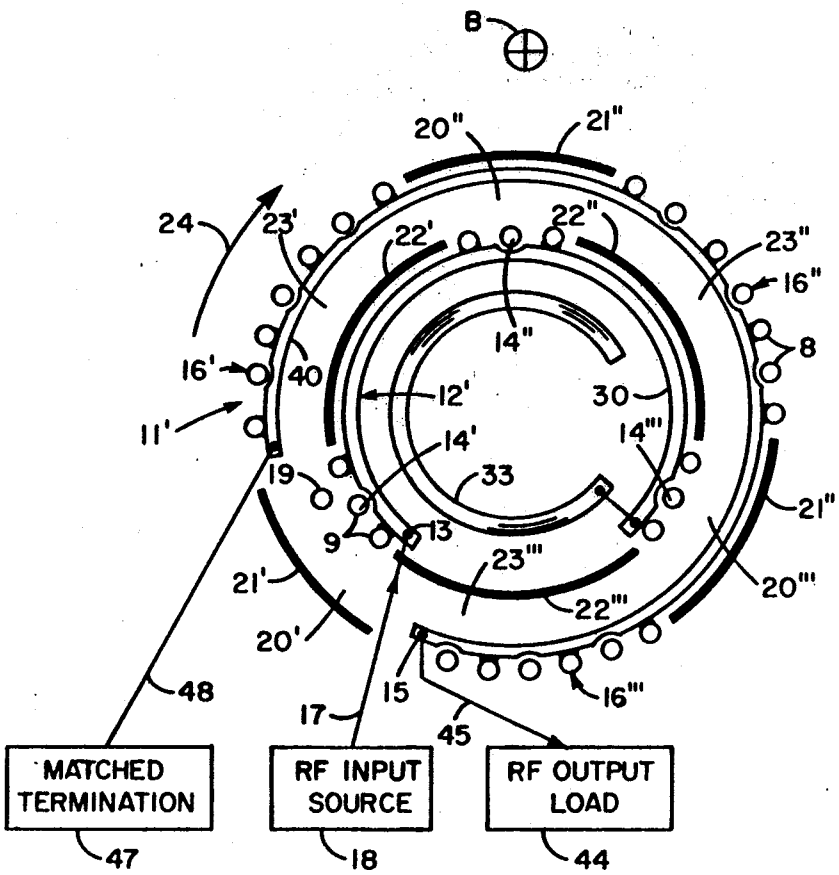
FIG. 5 is an end schematic view of another embodiment of a crossed-field amplifier of this invention.

In order to reduce the debunching of the electron cloud 19 in the anode interaction region 23, a modification of the embodiment of FIG. 1 is shown in schematic end view in FIG. 5. As shown in FIG. 5, three cathode slow-wave circuits 14', 14'', 14''' are shown circumferentially separated over the circumference of the cathode 12' by the cathode secondary electron emitter sole plates 22', 22'', 22'''. The anode 11' comprises slow-wave portions 16', 16'', 16''' separated by cylindrical sections of electrically conductive material 21', 21'', 21'''. As in FIGS. 2 and 4, electrical connections are made to the straps 40, 41 (not shown) of anode 11' and the straps 30, 31 (not shown) of cathode 12' to the source 18, the output 44 and the matched terminations 33, 47. FIG. 5 shows the anode and cathode slow-wave sections 16, 14 and plate sections 21, 22 as serially connected, respectively. It will be understood by those skilled in the art that the cathode and anode circuits each may have its corresponding elements connected in parallel. In operation, the electron cloud 19 bunching which occurs in the interaction region 20' will experience a debunching effect in the interaction region 23'. The circumferential extent of the interaction region 23' should be such that when the partially debunched electron cloud 19 reaches interaction region 20'', the field produced by slow-wave section 14'' will have the proper phase with respect to the partially debunched electron cloud so that bunching will occur during the time that the electron cloud is in the interaction region 20''. This proper phasing may be obtained by circumferentially locating the slow-wave section 14'' in the proper azimuthal position or, alternatively, by introducing the correct amount of phase delay in the RF input signal or in the electron cloud 19 by proper choice of the magnetic field B or the voltage applied between the anode and cathode. The process of bunching and debunching in the respective interaction regions 20, 23 of FIG. 5 results in the transfer of the high energy signal to the anode circuit at its output 15 with a reduced random noise content. The anode and cathode circuits of FIG. 5 may find their physical implementation in terms of the strapped bar lines of FIGS. 2 and 4 where FIGS. 2 and 4 are each modified to have more than one slow-wave section 14, 16 with corresponding increase in the number of plate sections 21, 22. It will also be recognized by those skilled in the art that the circumferential arc occupied by slow-wave sections and the planar sections of the anode and cathode need not be uniformly distributed nor of equal arcuate length along the circumference of the anode and the cathode.

Figure 6:
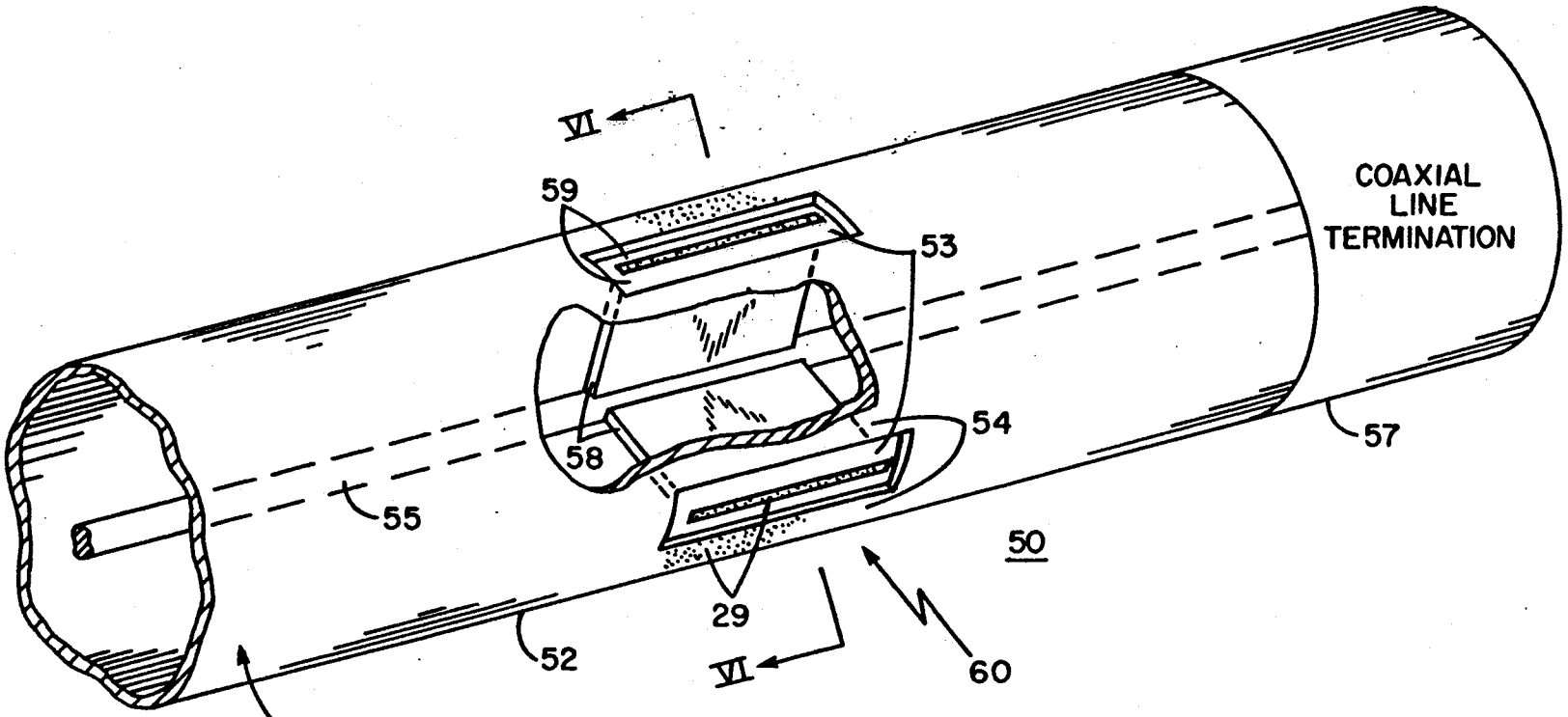
FIG. 6 is an isometric view of an alternate embodiment of a cathode suitable for a crossed-field amplifier.

Thus far, the anode 11 and cathode 12 have been described as having their slow-wave sections implemented by strapped bar configurations. FIG. 6 shows an isometric view of an alternative embodiment of a vane-type cathode 50 formed of a cylindrical coaxial line 51. The outer cylindrical conductor 52 of cathode 50 has slots 53 with the surface 54 between the slots 53 having an exterior electron emissive coating 29. The inner conductor 55 of the coaxial cathode 50 is shown radially extended to form vanes 58 from the center conductor 55 which bisect the space 53 in the outer conductor 52. Vanes 58 form gaps 59 at the edges of vane 58. Center and outer conductors 55, 52 may be terminated at the vanes 58 or may be extended to a matched termination 57 as shown in FIG. 6. The arrangement of vanes 58 and outer conductor 52 with its slots 53 forming the coaxial cathode 50 will when energized by an RF input source 18 result in a $\pi$-mode electric field between the vanes 58 and the adjacent wall edges of the slots 53. The circumferential extent of each slot 53 should be such that the pitch will be equal to that of the anode pitch for optimal coupling of the bunched electron beam to the cathode circuit formed of vane 58 and slot 53 and to the slow-wave circuit 16 of the anode 11 formed by the bars 8. It should also be noted that the exterior edge of vane 58 is coated with the secondary electron emissive material 29 as well as outer conductor sole-plate region 54.

The RF field section 60 formed of vane 58, slot 53, and the region 54 is oriented in the same azimuthal relation to the anode slow-wave structure 15 and the plain section 21 of FIGS. 1 or 4 so that a slow-wave structure 16 of the anode is radially opposite from the plain region 54 of the cathode and vice versa. It should further be noted that the axial length of the slot 53 should correspond approximately to the axial length of the anode bars 9.

The cathode structure shown in FIG. 6 has three RF field generating regions 60, each of two pitches, equally angularly distributed over the circumference of the cylindrical cathode 50. It should be noted that a lesser or a greater number of cathode 50 RF field regions 60 with the same or an unequal number of pitches in each region 60 may be utilized with a corresponding number of radially opposite and arcuately coextensive anode plain regions 21. There also need not be equal circumferential spacing of the regions 60.

Figure 7:
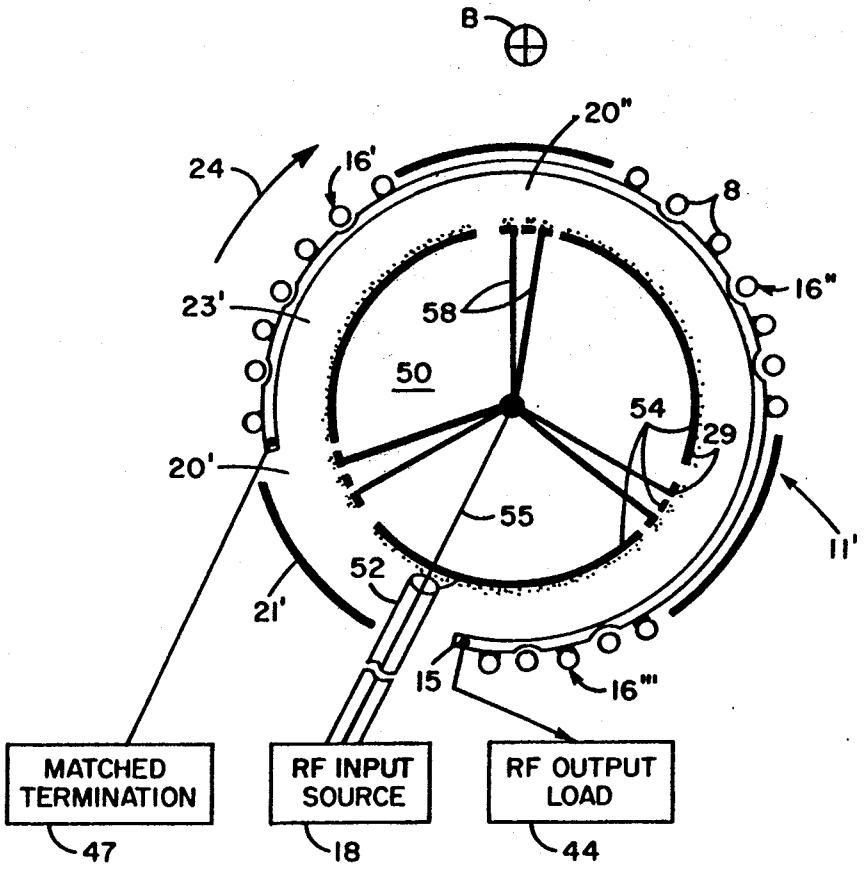
FIG. 7 is a cross-sectional view of FIG. 6 in conjunction with an anode showing another embodiment of a CDCFA of this invention.

FIG. 7 shows a sectional view taken along section lines VI—VI of FIG. 6 of the cathode 50 slightly modified from that of FIG. 6 in that two vanes 58 providing three pitches are shown for each of the cathode RF field regions 60. FIG. 7 also includes the anode 11' of FIG. 5 to show its spatial relationship with respect to the vanes 58 of the cathode 50. It is noted that the axes of symmetry of the cathode 50 and the anode 11' are coincident, and that anode 11' is shown as having strapped bar slow-wave circuits 15 although the anode also could be of the strapped bar vane type known to those skilled in the art. The coaxial cathode 50 is shown connected to an RF input source 18 with its center conductor 55 having vanes 58 extending radially. The outer conductor 52 of the coaxial cathode 50 forms the sole plates 54 which together with the ends 60 of vanes 58 have electron secondary emitter material 29 on their exterior surface. The output of the anode circuit 11' is shown to be a general type of load, including an input to a linear accelerator 44' or a resonant cavity. Other numerals on FIG. 7 correspond to elements which have been discussed in preceding figures.

Having described a preferred embodiment of the invention, it will be apparent to one of skill in the art that other embodiments incorporating its concept may be used. It is felt, therefore, that this invention should not be limited to the disclosed embodiment but rather should be limited only by the spirit and scope of the appended claims.

What is claimed is:

1. A cathode-driven crossed-field amplifier (CDCFA) tube comprising:

a cathode slow-wave RF-field producing circuit and an anode slow-wave RF-field producing circuit;

said cathode and anode RF-field producing circuits having their respective RF fields substantially directly uncoupled;

said cathode having an input adapted to receive an RF signal voltage; and said anode having an output adapted to provide an amplified said RF signal voltage to a load.

2. The circuit of claim 1 wherein said cathode circuit and said anode circuit are also adapted to be connected to respective matched terminations.

3. The circuit of claim 1 wherein:

said cathode provides electrons to said cathode and anode RF fields in response to an RF signal voltage applied to the input of said cathode; and said cathode RF field is coupled to said anode RF field by said electrons.

4. The circuit of claim 1 wherein said cathode RF-field producing circuit is a stapped-bar slow-wave circuit.

5. The circuit of claim 1 wherein said cathode RF-field producing circuit is a vane-type circuit producing a $\pi$-mode electric field at the ends of the vanes.

6. The circuit of claim 1 wherein said cathode RF-field producing circuit comprises:

a coaxial line having an inner center conductor on an axis and an outer concentric conductor;

said inner conductor having at least one attached vane extending radially from and longitudinally along said center conductor;

said outer conductor having a slot into which said vane extends without contacting said outer conductor; and said outer conductor and said vane having a secondary electron emission layer on their outer surfaces extending longitudinally along said vane.

7. The circuit of claim 1 wherein said anode RF-field producing circuit is a strapped-bar slow-wave circuit.

8. The circuit of claim 1 wherein said cathode has a plurality of said RF-field producing circuits separated from each other by a plurality of cathode sole plates.

9. The circuit of claim 8 wherein:

said anode has a plurality of said RF-field producing circuits separated from each other by a plurality of anode plates; and said anode plates being radially opposite said cathode circuits.

10. The circuit of claim 1 wherein:

said cathode RF-field producing circuit is sufficiently remote from said anode RF-field producing circuit to reduce direct RF field coupling between said circuits to less than the amplification which said CDCFA provides when energized by an RF signal applied to an input of said cathode circuit and an output of said anode circuit.

11. A cathode-driven crossed-field amplifier (CDCFA) tube circuit comprising:

a CDCFA tube having a cathode slow-wave RF-field producing circuit and an anode slow-wave RF-field producing circuit;

said cathode and anode RF-field producing circuits having their respective RF fields substantially directly uncoupled;

a pulsed RF signal source connected to said cathode circuit; and an RF load connected to said anode circuit.

12. The circuit of claim 11 wherein said RF load has an impedance mismatched to the impedance of said anode.

13. The circuit of claim 11 wherein said RF load is a resonant cavity.

14. The circuit of claim 11 wherein said RF load is a cavity resonant at the frequency of said RF signal source.

15. The circuit of claim 11 wherein said RF load is the drive input of a cavity of a linear accelerator.

16. The circuit of claim 11 wherein said RF load is the drive input of a cavity of a linear accelerator resonant at the frequency of said RF signal source.

17. The circuit of claim 11 wherein said cathode circuit and said anode circuit are also connected to respective matched terminations.

18. The circuit of claim 11 wherein:

said cathode provides electrons to said cathode and anode RF fields; and said cathode RF field is coupled to said anode RF field by said electrons.

19. The circuit of claim 11 wherein said cathode RF-field producing circuit is a stapped-bar slow-wave circuit.

20. The circuit of claim 11 wherein said cathode RF-field producing circuit is a vane-type circuit producing a $\pi$-mode electric field at the ends of the vanes.

21. The circuit of claim 11 wherein said cathode RF-field producing circuit comprises:

a coaxial line having an inner center conductor on an axis and an outer concentric conductor;

said inner conductor having at least one attached vane extending radially from and longitudinally along said center conductor;

said outer conductor having a slot into which said vane extends without contacting said outer conductor; and said outer conductor and said vane having a secondary electron emission layer on their outer surfaces extending longitudinally along said vane.

22. The circuit of claim 11 wherein said anode RF-field producing circuit is a straped-bar slow-wave circuit.

23. The circuit of claim 11 wherein said cathode has a plurality of said RF-field producing circuits separated from each other by a plurality of cathode sole plates.

24. The circuit of claim 23 wherein:

said anode has a plurality of said RF-field producing circuits separated from each other by a plurality of anode plates; and said anode plates being radially opposite said cathode circuits.

25. A cathode-driven crossed-field amplifier tube comprising:

a cathode and an anode;

said cathode having a first slow-wave circuit forming a portion of said cathode and a sole plate forming the remainder of said cathode;

said anode having a second slow-wave circuit on a portion of said anode and a plate forming the remainder of said anode;

said cathode slow-wave circuit being adjacent said anode plate;

said anode slow-wave; circuit being adjacent said cathode plate;

said anode slow-wave circuit being remote from said anode slow-wave circuit.

26. The tube of claim 25 wherein said cathode first slow-wave circuit and said cathode sole plate are adapted to provide electrons.

27. The tube of claim 26 wherein said electrons are provided in part by secondary emission.

28. The tube of claim 25 wherein:

said cathode first slow-wave circuit has a first input and a first output;

said first input being adapted to be connected to an RF signal source; and said first output being adapted to be connected to a first impedance termination matched to the impedance of said first slow-wave circuit.

29. A cathode driven crossed-field amplifier comprising:

a cylindrical cathode and a cylindrical anode;

said cathode having a first slow-wave circuit on an azimuthal portion of said cathode cylinder and a sole plate forming the azimuthal remainder of said cathode;

said anode having a second slow-wave circuit on an azimuthal portion of said anode cylinder and a plate forming the azimuthal remainder of said anode;

said cathode slow-wave circuit being located azimuthally such that it is radially opposite said anode plate; and said cathode and anode slow-wave circuits being displaced azimuthally to reduce direct RF field coupling between said circuits.

30. The tube of claim 29 wherein said cathode first slow-wave circuit and said cathode sole plate are adapted to provide electrons.

31. The tube of claim 30 wherein said electrons are provided in part by secondary emission.

32. The tube of claim 29 wherein:

said cathode first slow-wave circuit has a first input and a first output;

said first input being adapted to be connected to an RF signal source; and said first output being adapted to be connected to a first impedance termination matched to the impedance of said first slow-wave circuit.

* * * * *